US007854155B2

(12) United States Patent
Sudau et al.

(10) Patent No.: US 7,854,155 B2
(45) Date of Patent: Dec. 21, 2010

(54) METHOD AND ROLLING MILL FOR IMPROVING THE RUNNING-OUT OF A ROLLED METAL STRIP WHOSE TRAILING END IS MOVING AT ROLLING SPEED

(75) Inventors: Peter Sudau, Hilchenbach (DE); Olaf Norman Jepsen, Siegen (DE)

(73) Assignee: SMS Siemag Aktiengesellschaft, Duesseldorf (DE)

( * ) Notice: Subject to any disclaimer, the term of this patent is extended or adjusted under 35 U.S.C. 154(b) by 306 days.

(21) Appl. No.: 11/795,456

(22) PCT Filed: Oct. 26, 2006

(86) PCT No.: PCT/EP2006/010342

§ 371 (c)(1),
(2), (4) Date: Jul. 16, 2007

(87) PCT Pub. No.: WO2007/057098

PCT Pub. Date: May 24, 2007

(65) Prior Publication Data

US 2008/0302158 A1 Dec. 11, 2008

(30) Foreign Application Priority Data

Nov. 18, 2005 (DE) ..... 10 2005 055 106

(51) Int. Cl.
*B21B 37/58* (2006.01)

(52) U.S. Cl. ..... 72/10.4; 72/14.4

(58) Field of Classification Search ..... 72/10.4, 72/10.5, 14.4, 7.5, 8.8, 11.5, 10.1, 245, 248
See application file for complete search history.

(56) References Cited

U.S. PATENT DOCUMENTS 5,666,837 A * 9/1997 Kajiwara et al. ..... 72/14.4
6,065,318 A * 5/2000 Maniwa et al. ..... 72/14.5

(Continued)

FOREIGN PATENT DOCUMENTS

JP 61017318 A 1/1986

(Continued)

OTHER PUBLICATIONS

Bilkhu et al: "Automation and ho strip mill modernization", Iron and Steel Engineer, Aug. 1995, pp. 27-33.

(Continued)

*Primary Examiner*—Dana Ross
*Assistant Examiner*—Mohammad Yusuf
(74) *Attorney, Agent, or Firm*—Andrew Wilford

(57) ABSTRACT

A method for improving the running-out of a metal rolled strip (1), the rolled trailing strip end (1*a*) of which exits out of a respectively last roll stand (2) of a multistand rolling mill (3) at a rolling speed, wherein during rolling between two consecutive roll stands (F1, F2, F3 . . . Fn) the strip tension (a) is adjusted to stabilize the strip position, provides that shortly before the rolled trailing strip end (1*a*) exits the developing rolling force differences are measured separately for each roll stand (F1, F2, F3 . . . Fn), that from this the pivot value (16) and the pivot direction are derived for forming a corrective value for the adjustment of the rolls (10, 11) and that the adjustment is corrected.

8 Claims, 3 Drawing Sheets

U.S. PATENT DOCUMENTS

| | | | | |
|---|---|---|---|---|
| 6,142,000 | A | 11/2000 | Rohde | |
| 6,148,653 | A * | 11/2000 | Sako et al. | 72/11.5 |
| 6,619,087 | B2 * | 9/2003 | Ogawa et al. | 72/14.4 |
| 6,983,631 | B2 | 1/2006 | Seidel | |
| 7,310,982 | B2 | 12/2007 | Ogawa et al. | 72/10.4 |
| 7,481,090 | B2 * | 1/2009 | Ogawa et al. | 72/10.4 |

FOREIGN PATENT DOCUMENTS

| | | | |
|---|---|---|---|
| JP | 63020113 | A | 1/1988 |
| JP | 63183713 | A | 7/1988 |
| JP | 05038514 | A | 7/1991 |
| JP | 7144211 | A | 6/1995 |
| JP | 08267117 | | 10/1996 |
| JP | 09085323 | | 3/1997 |
| JP | 09262615 | A | 10/1997 |
| JP | 10005840 | | 1/1998 |
| JP | 10175010 | A | 6/1998 |
| JP | 11244921 | A | 9/1999 |
| JP | 2002292416 | A | 10/2002 |
| WO | WO2006/063948 | A1 | 6/2006 |

OTHER PUBLICATIONS

Smith et al: "The upgrade of the rouge steel hot strip mill", AISE Steel Technology magazine, Jun. 2003.

* cited by examiner

METHOD AND ROLLING MILL FOR IMPROVING THE RUNNING-OUT OF A ROLLED METAL STRIP WHOSE TRAILING END IS MOVING AT ROLLING SPEED

CROSS REFERENCE TO RELATED APPLICATIONS

This application is the U.S. national phase of PCT application PCT/EP2006/010342, filed 26 Oct. 2006, published 24 May 2007 as WO 2007/057098, and claiming the priority of German patent application 102005055106.8 itself filed 18 Nov. 2005, the entire disclosures of which are herewith incorporated by reference.

The invention relates to a method and a rolling mill for improving the running-out of a rolled metal rolled strip whose trailing end exits of the last roll stand of a multistand rolling mill at rolling speed, where during rolling strip tension is adjusted between adjacent stands to stabilize the strip position.

During hot rolling of steel, the rolling speed is adjusted such that a required final rolling temperature of the metal strip, particularly a steel strip, is reached. This final rolling temperature must be maintained to achieve the desired metallurgical properties. A decrease of rolling speed is undesirable, even at the trailing end of the strip. Running-out the metal strip at rolling speed, however, is problematic, particularly at high rolling speeds with thin final thicknesses.

During rolling, the strip tension set between the roll stands is a crucial factor for stabilizing the strip position. When running-out the rolled trailing strip end from a stand, the strip tension drops to zero shortly before or at the latest during running-out from the roll stand. The rolled trailing strip end is then pulled into the next roll stand without tension. During this phase, the strip position is uncontrolled and smaller malfunctions or deviations can result in "wandering" of the rolled trailing strip end in the roll gap. In such a case, the metal strip shifts out of the center of the stand and produces rolling force differences and uneven positioning of the roll gap, resulting in turn in accelerated shifting. The causes for this process can be a roll gap that is not parallel, temperature differences across the strip width, a wedge profile over the strip width or strip hardness differences.

It is known (EP 0 875 303 B1) [U.S. Pat. No. 6,142,000] to provide control of the roll gap by correcting the force difference between the roll drive and operator sides of the roll stands while compensating for the bending and balancing forces with a feedback control value-regulating control system for the roll gap. The control system is fed an additional corrective control value formed by the horizontal forces measured on all individual rolls before further processing of the flat products. The solution is a so-called cross-module that allows the expansion values to be converted to both stand sides. The expansion values can be compensated for by corresponding position set points for the two position set points of the two adjustment systems on the drive side and the operator side of the roll stands.

If the errors at the rolled trailing strip end are too large, this control system however is not in a position to stabilize the metal rolled strip.

Existing attempts made, such as the operators intervening in the rolling operation to minimize or even prevent shifting of the rolled trailing strip end or replace the operator by an automatic controller, have not produced satisfactory results. When intervening with the starting position as strip tension drops, shifting of the rolled trailing strip end cannot be avoided and misrolling and the associated problems occur in the following roll stands. In the worst case, the rolled trailing strip end tears, resulting in damage to the working and support rolls. In the case of metal rolled strips, which can only have a few surface defects (thin steel strip), a single event of misrolling may require the rolling operation to be interrupted and the working rolls to be replaced in one or more stands.

It is therefore the object of the invention to consider the running-out of the rolled trailing strip end at the respectively last roll stand of a rolling mill as a separate step and evaluate the adjustment of the rolling forces on both sides of the roll stand in a timely manner.

The object at hand is achieved according to the invention in that shortly before the rolled trailing strip end leaves a stand the rolling forces applied on the drive side and the service side are measured separately for each roll stand and the difference is calculated, that from this a pivot value and the pivot direction of the rolling force difference is derived so as to form a corrective value for positioning of the rolls and the position is corrected.

The advantage is that the conditions prior to running-out are improved, and transverse shifting of the rolled trailing strip end is largely prevented. The direction and the value of the rolling force difference are determined for this phase and consequently a "pivot value" for the metal rolled strip is computed. These steps are carried out separately for each roll stand, so that the properties of the metal rolled strip at this point as well as its geometric values, the thickness and hardness, flatness and surface are considered in the measurement.

One embodiment provides that the results of the measuring steps are used automatically within the ongoing rolling process from one roll stand to another, or adaptively from one metal rolled strip to another. The advantage is that experience gained is used in the process.

One application possibility of this is that the measurement result is displayed for the operator in the control center and that the operator performs the correction manually during the rolling operation.

Another application is that after running-out of the rolled trailing strip end a mean value of the rolling force difference between the drive side and the service side is formed for a selected strip length and used for the next metal rolled strip.

A rolling mill for the hot rolling of a metal rolled strip, particularly a thin steel strip, has a plurality of roll stands operating on a rolling line, the working rolls and support rolls of which are driven on the drive side so as to maintain the strip tension for stabilization of the passage and to achieve a high rolling speed, and wherein measuring devices are provided on the drive side and on the service side for measuring the rolling force.

The task at hand is achieved according to the invention in that the rolling forces on the drive side and on the service side can be determined in the form of a rolling force difference value by means of force-measuring sensors shortly before the rolled trailing strip end exits, that an evaluation unit for the force difference of the metal trailing strip end and a computer unit for computing a pivot value for the adjustment of the rolls as the metal trailing strip end passes through are provided. The advantages are the same as those already outlined for the method.

In one embodiment of the roll stands, it is proposed that the force-measuring sensors for the rolling force difference of the metal trailing strip end are load cells mounted underneath respective ends of the lower support roll.

A further configuration of the measuring devices is such that a switch for forwarding the pivot value is connected to the computer, which value is forwarded either to an automatic system for consideration in the current or next metal rolled strip and/or to a display unit for a pivot recommendation to the operator.

In addition, it is advantageous if the automatic system and/or the display are connected to a pivot set-point comparison unit and/or a pivot actual-value comparison unit and if both are connected to a position control unit of the hydraulic adjustment on the drive side or a position control unit of the hydraulic adjustment on the service side.

A further embodiment proposes connecting the position-control units to cylinder-force control units for the drive side and the service side, while including a position-control unit for the absolute-position set point.

The drawing illustrates illustrated embodiments of the method and the configuration of the controller, which will be described in more detail hereinafter. Therein:

Figures 1A, 1B:
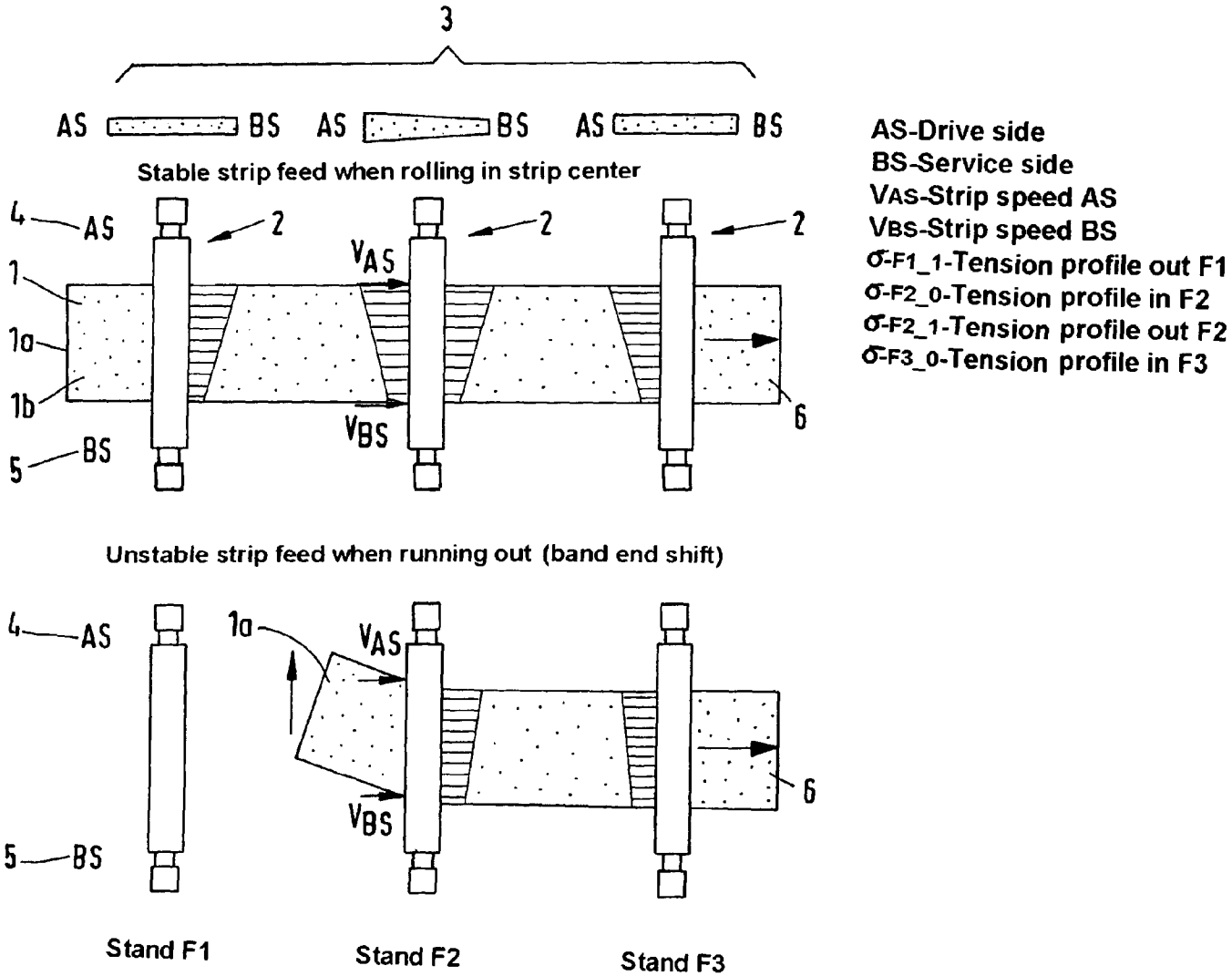
FIG. 1A shows stable passage during rolling with strip tension.
FIG. 1B shows unstable passage during running-out of the trailing strip end that "shifts" if the adjustment of the rolls is not parallel and symmetrical.
Figure 2:
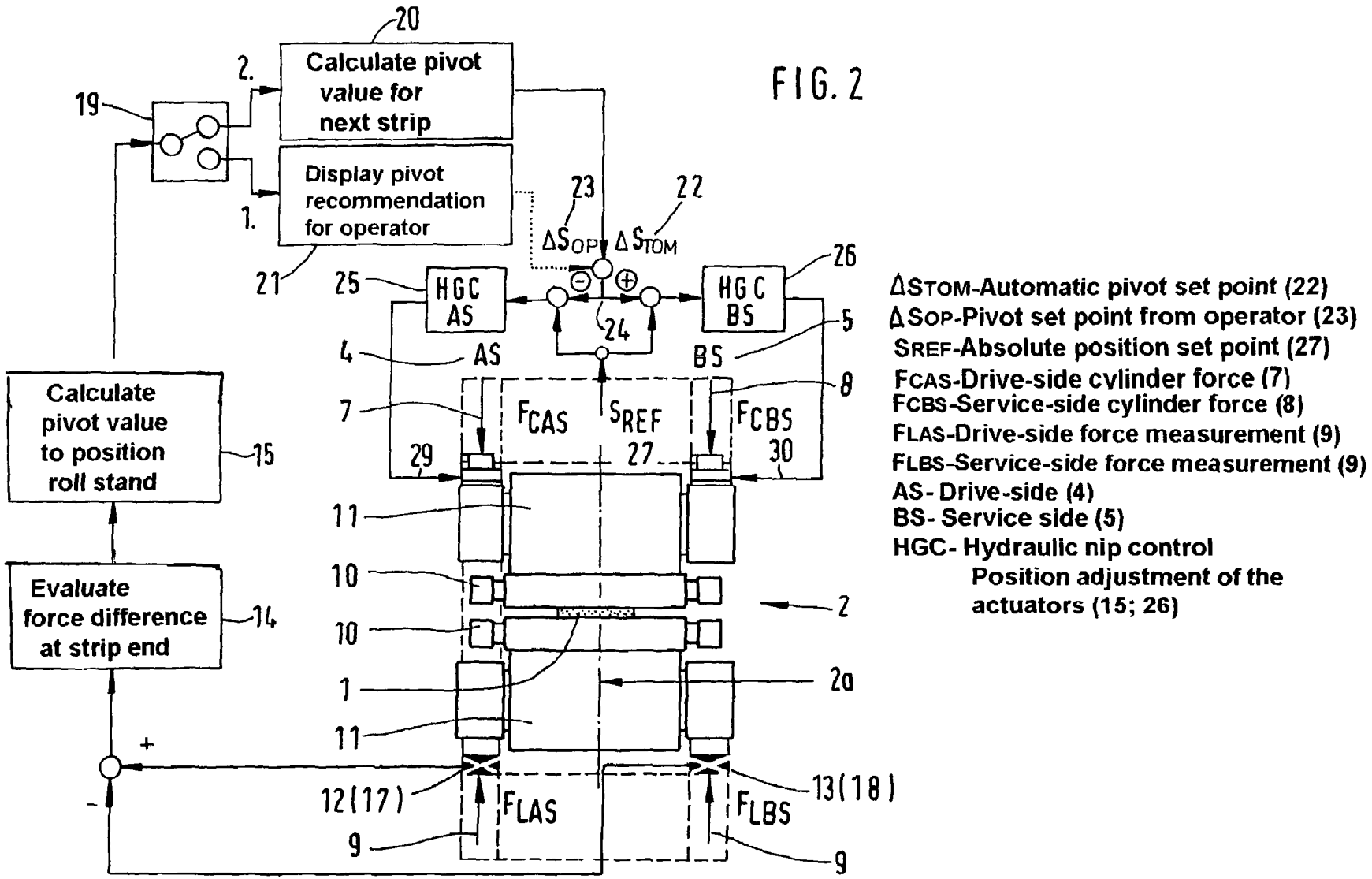
FIG. 2 is a block diagram for the controller of the method.

FIG. 1A shows a stable passage illustration when rolling a metal rolled strip 1, the rolled trailing strip end 1*a* moving into the furthest upstream roll stand 2 of a hot rolled strip rolling mill 3. The rolling forces are assumed to be acting symmetrically to a stand center 2*a* (FIG. 2). In stand F2, the position of rolls 10 and 11 is not parallel, but instead wider on drive side 4 than on service side 5. Since the metal rolled strip 1 is tightly gripped in the upstream and downstream flanking stands F1 and F3, this setting creates an asymmetrical strip stress distribution across the width of the strip, thus stabilizing its movement and preventing the metal rolled strip 1 from shifting to the side. In this state, the strip speeds are the same on the drive side 4 and the service side 5 of the stand F2.

FIG. 1B illustrates an unstable strip position example during running-out of the rolled trailing strip end 1*a*, where after running-out of the rolled trailing strip end 1*a* from the stand Fl the stabilizing strip tension is gone, resulting in different strip tension speeds between the drive side 4 and the service side 5 of the stand F2. The metal rolled strip 1 is fed in this case at a higher speed on the drive side 4, so that the rolled trailing strip end 1*a* twists and shifts toward the drive side 4. Such a process is dangerous and may result in the damage referred to above.

After the rolled trailing strip end 1*a* leaves the stand center 2*a* (see FIG. 2), the rolling forces produced on the drive side 4 and on the service side 5 are compared, or they are measured separately for each roll stand F1, F2, F3, Fn . . . and are then evaluated. These readings are then used to compute the direction and the rolling force difference value.

The results of the measuring steps are used automatically within the ongoing rolling operation from one roll stand (F1) to another roll stand (F2 . . . F3 . . . Fn) or adaptively from one metal strip 1 to a new metal strip 1.

One processing application of this is that the measurement result is displayed for the operator on a monitor at the control center and the operator performs the correction manually during the rolling operation.

Another possibility is to form a mean value of the rolling force difference between the drive sides 4 and the service sides 5 for a selected strip length after running-out the rolled trailing strip end 1*a* and use this value for the next metal rolled strip 1.

FIG. 2 shows a roll stand 2 of the hot rolled strip rolling mill 3 (FIG. 1), whose working rolls 10 and support rolls 11 are driven on the drive side 4, the strip tension being adjusted for stabilization of the strip position and for high rolling speed. In addition, the sensors described below are provided on the drive side 4 and on the service side 5 for measuring the rolling force.

As the rolled trailing strip end 1*a* leaves the roll stand 2, the rolling forces in the next roll stand 2 on the drive side 4 and on the service side 5 are measured using force-measuring sensors 12 and 13 (for example load cells 17 and 18) and from this the rolling force difference is determined; thereafter, the rolling force difference is determined in an evaluation unit 14 as the actual rolling force difference of the metal trailing strip end 1*a* occurring in the individual case. A connected computer 15 is used to calculate a corrective value, which is referred to as the "pivot value" 16, for the adjustment of the working and support rolls 10 and 11. The "pivot value" 16 thus refers to a correction of the adjustment of the rolls 10 and 11 in a roll stand 2. In addition to load cells 17 and 18, possible force-measuring sensors 12 and 13 for the rolling force difference of the metal trailing strip end 1*a* also include other expansion or compressive force-measuring devices that can be provided in the roll stand.

Furthermore (see FIG. 2), a switch 19 for forwarding the pivot value 16 is connected to the computer 15, so the value is forwarded either to an automatic unit 20 for consideration on the current or next metal rolled strip 1 and/or to a display 21 with a pivot recommendation for the operator. Accordingly, the automatic pivot set point 23 from the operator is forwarded to a switch 24 that feeds the values to a position-control unit 25 of the hydraulic nip adjustment at the drive side (of the rolls) and to a position-control unit 26 of the hydraulic nip adjustment on the service side 5. The pivot set points 22 and 23 are added to the absolute position set point 27 or subtracted from it.

The position-control units 25 and 26 of the hydraulic adjustments on the drive side 4 and on the service side 5 operate with these position set points and are connected to respective cylinder-force control units 29 and 30 for the drive side 4 and the service side 5.

Figure 3:
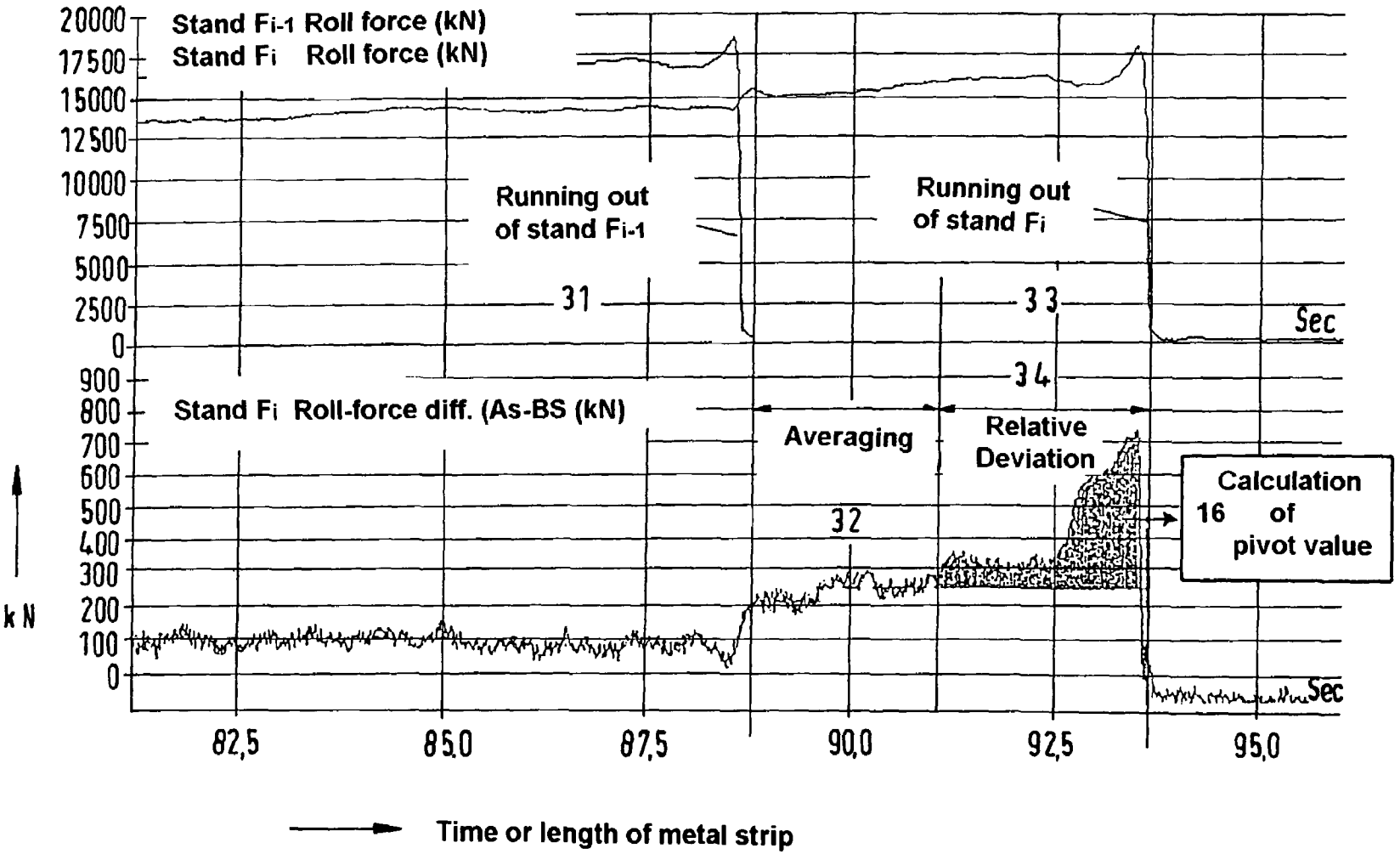
FIG. 3 shows computation of the "pivot value" based on the rolling forces occurring in the consecutive roll stands of a strip rolling mill.

FIG. 3 illustrates examples of evaluations of the force difference on the rolled trailing strip end 1*a*. After running-out 31 from the stand $F_{i-1}$, a mean value 32 of the force differential is formed for a certain time or strip length. For the remaining time or strip length until running-out 33 from the stand Fi, a relative deviation 34 is integrated in this mean value. The amount of the value computed this way determines the amount of the pivot value 16 and the "pivot" direction.

REFERENCE LIST

1 metal rolled strip
1*a* rolled trailing strip end
1*b* thin steel strip
2 roll stand
2*a* stand center
F1, F2, F3 . . . Fn roll stands following in the rolling line
3 hot rolled strip rolling mill
4 drive side
5 service side
6 rolling direction
7 force of the piston-cylinder unit on the drive side
8 force of the piston-cylinder unit on the service side

9 force measurement side
10 working roll
11 support roll
12 force-measuring sensor on the drive side
13 force-measuring sensor on the service side
14 evaluation unit
15 computer
16 "pivot value"
17 load cell
18 load cell
19 switch for data forwarding
20 automatic system
21 display for pivot recommendation
22 automatic pivot set point
23 pivot set point for controller
24 switch
25 drive-side position control unit of hydraulic adjustment
26 service-side position control unit of hydraulic adjustment
27 absolute position set point
28
29 cylinder force controller
30 cylinder force controller
31 running-out from stand
32 mean value
33 running-out from stand $F_i$
34 relative deviation from mean value

The invention claimed is:

1. A method of operating a rolling system having at least three roll stands that grip a metal strip and advance it in a feed direction with each stand having a service side and a drive side spaced transversely apart relative to the direction, the method comprising the steps of:

during a typical rolling operation with the strip extending through all three of the stands, varying the pressure applied at each stand to the strip at the drive side and at the service side so as to keep the strip centered in the roll stands, whereby the pressure applied in any of the stands can be different between the respective drive and service sides;

shortly before a trailing end of the strip moves downstream through the stands, measuring the pressure applied by each stand at each of the respective sides and calculating for each stand a difference between the pressure applied at the respective service side and the respective drive side to the strip;

generating for each stand a pivot-angle correction value corresponding to the respective difference and a pivot-direction correction value corresponding to which side is applying the greater force; and applying correcting force at each stand in accordance with the respective correction values when the trailing end of the strip passes through such that the pressure applied to the strip by each stand is generally equal between the respective service and drive sides.

2. The method according to claim 1, further comprising the step of displaying the correction values for the operator in a control center such that the operator can execute the correction manually during the rolling operation.

3. The method according to claim 1, further comprising the step after running-out of the rolled trailing strip end of forming a mean value of the rolling force difference between the drive side and the service side of each stand for a selected strip length and using it for the next metal rolled strip.

4. In a rolling system having at least three roll stands that grip a metal strip and advance it in a feed direction with each stand having a service side and a drive side spaced transversely apart relative to the direction and wherein during a typical rolling operation with the strip extending through all three of the stands the pressure applied at each stand to the strip is varied at the drive side and at the service side so as to keep the strip centered in the roll stands, whereby the pressure applied in any of the stands can be different between the respective drive and service sides, the improvement comprising:

sensor means for, shortly before a trailing end of the strip moves downstream through the stands, measuring the pressure applied by each stand at each of the respective sides and calculating for each stand a difference between the pressure applied at the respective service side and the respective drive side to the strip; and computer and evaluating means connected to the sensor means for generating for each stand a pivot-angle correction value corresponding to the respective difference and a pivot-direction correction value corresponding to which side is applying the greater force, whereby correcting force can be applied at each stand in accordance with the respective correction values when the trailing end of the strip passes through such that the pressure applied to the strip by each stand is generally equal between the respective service and drive sides.

5. The rolling mill according to claim 4 wherein the sensor means are load cells mounted underneath the lower support roller.

6. The rolling mill according to claim 4, further comprising a circuit for forwarding the pivot value is connected to the computer means, which value is forwarded either to an automatic system for consideration on the current or next metal rolled strip or to a display with a pivot recommendation for the operator.

7. The rolling mill according to claim 6 wherein the automatic system or the display are connected to a pivot set point comparison unit or a pivot actual value comparison unit and that both are connected to a position control unit of the hydraulic adjustment on the drive side or to a position control unit of the hydraulic adjustment on the service side.

8. The rolling mill according to claim 7 wherein the position control units are connected to a cylinder force controller for the drive side and the service side, with the integration of a position controller for the absolute position set point.

* * * * *